US006099614A

United States Patent [19]

Bennati

[11] Patent Number: 6,099,614

[45] Date of Patent: Aug. 8, 2000

[54] METHOD AND EQUIPMENT FOR A TREATMENT IN MOLTEN CAST IRON BATHS WITH REACTION MATERIALS HAVING A LOW OR HIGH PRODUCTION OF GAS

[76] Inventor: Ettore Bennati, Via Giovanni XXIII n.3, Corte Franca (Brescia), Italy

[21] Appl. No.: 08/875,427

[22] PCT Filed: Dec. 20, 1995

[86] PCT No.: PCT/IT95/02223

§ 371 Date: Jul. 3, 1997

§ 102(e) Date: Jul. 3, 1997

[87] PCT Pub. No.: WO96/21046

PCT Pub. Date: Jul. 11, 1996

[30] Foreign Application Priority Data

Jan. 5, 1995 [IT] Italy ..... BS95A0003

[51] Int. Cl.[7] ..... C21C 1/10

[52] U.S. Cl. ..... 75/414; 75/568; 266/216; 420/19

[58] Field of Search ..... 266/216; 420/19; 75/568, 414

[56] References Cited

U.S. PATENT DOCUMENTS 4,447,046 5/1984 Beele ..... 266/216

FOREIGN PATENT DOCUMENTS 0 512 255 A1 11/1992 European Pat. Off. .
382 783 12/1964 Netherlands .
439 359 12/1967 Netherlands .
804693 2/1981 Russian Federation ..... 266/216

*Primary Examiner*—Melvyn Andrews
*Attorney, Agent, or Firm*—McGlew & Tuttle, P.C.

[57] ABSTRACT

This invention covers the method and equipment for the continuous or discontinuous addition of reaction/inoculation materials necessary for desulphurization or the production of ductile iron obtainable during the passage of the base iron through a basin containing the chamber for melting, vaporizing and distributing the reaction-inoculation materials into the melt (e.g. magnesium vapor-Ferrum Silicon). The treatment can be conducted continuously for unlimited or freely definable quantities of iron.

19 Claims, 3 Drawing Sheets

METHOD AND EQUIPMENT FOR A TREATMENT IN MOLTEN CAST IRON BATHS WITH REACTION MATERIALS HAVING A LOW OR HIGH PRODUCTION OF GAS

FIELD OF THE INVENTION

This invention concerns metallurgical treatments in molten baths obtained by means of the delivery of reaction materials that can be vaporized with a high or low generation of gas and other inoculating or refining materials.

BACKGROUND OF THE INVENTION

There already exist known metallurgical treatments in molten baths—for instance ductile iron—which use as the reaction material pure magnesium, or its alloys, which is vaporized in the molten bath to obtain spheroidal graphite and modifications thereof, or for desulphurization, deoxidation or similar treatments.

Using traditional techniques, vaporization is obtained by means of direct contact between the reaction material and the molten metal. The required quantity of reaction material is placed directly in the molten metal and heated and vaporized by it. The supply of reaction material and the metallurgical treatment are generally discontinuous, and also involve significant loss of vapor and deformities of the bath treatment.

Known methods currently used for cast iron, particularly those using pure metallic magnesium at atmospheric or metallostatic pressure, have an efficiency or no more than 60%; virtually 40% of the reagent fed into the bath is lost in the form of fumes and heat. The reason for this lies in the production of vapor, which is discontinuous with irregular peaks of high pressure generated when the liquid or solid reagent comes into contact with the molten metal.

Various methods have been designed to reduce this loss and the resulting environmental impact, some of which also envisage continuous treatment of the metal flow as shown in CH-A43993599. Document CH-A-382783 discloses the possibility of improving the technology by using a continuous process of feeding the reagent material in the form of a wire into a pressurized bell immersed in a molten bath. However, the continuous distribution described here does not allow constant vaporization because when the liquid/solid reagent comes into direct contact with the molten bath, it causes cooling and consequently halts vaporization, and hence the stated aims are not attained.

More recently, a method of metallurgical treatment in a molten bath has been proposed. The molten bath is of a vaporizable reaction material in which the reaction material is placed in at least one chamber, immersed in the molten metal and vaporized without direct contact with the metal. In effect, the reaction material is heated and vaporized through the walls of the chamber and the vapor produced is conveyed out of the chamber towards the molten metal.

However, this method too is discontinuous although it provides some advantages in the use and distribution of vapor in the molten metal for a more homogenous treatment.

In other words, metallurgical treatments conducted with known methods are discontinuous considering the discontinuous supply of reaction material. On the other hand, for some treatments, apart from the vaporizable material it is necessary to have inoculating or refining material for the bath. Metering and delivery to the bath of these materials are generally effected by simple addition during transfer of the metal and cause oxidation and the formation of residue leading to defects in the castings produced.

SUMMARY AND OBJECTS OF THE INVENTION

The concomitant, but separate, delivery of reaction and inoculating materials effected from inside the bath in a protected atmosphere is not known in the current state of the art. This invention aims to prevent the limitations of continuous or discontinuous metallurgical treatments according to known methods by means of a method and equipment allowing the continuous treatment of molten material, even with a concomitant supply of reaction materials and inoculating materials directly into the bath. This invention applies in particular to the metallurgical treatments of desulphurization, nodularization, etc. of iron, but without excluding a more general application to the treatment of other hot liquids whether metallic or otherwise. The invention was conceived, at least as far as treatment in melt baths—particularly ductile iron—is concerned, starting from the known technique of placing the reaction material in a chamber immersed in the molten bath, but with the innovation of feeding continuously from the external environment at atmospheric pressure, by means of a pressure-tight metering system controlled by a regulator depending on the data relating to the metal to treat, materials promoting the formation of spheroids even with a high gas generation, called reagents, and separately but concomitantly, other materials for refining or solidifying the graphite in the bath according to the stable system, hereinafter referred to as inoculants.

The invention is applicable to treatments in discontinuous molten baths in containers that can be emptied, for example, into ladles, with continuous delivery during the process of reagent and, if necessary, inoculant based on the metallurgical quantities and characteristics found, and thus known, of the bath to treat. This invention is also applicable to continuous molten baths, which transit in a basin or channel, by means of a continuous supply of reagent and, if necessary, of inoculant depending on the variable conditions of the metal arriving.

Reagents and inoculating materials are fed through a special chamber, called a reactor, the pressure of which is kept the same as the metallostatic pressure of the bath in which it is immersed and having a vaporization chamber and an expansion chamber. The reagents are introduced continuously into the vaporization chamber and pass from a solid state to a vapor by means of the high temperature of the bath or, in the case of reagents with a higher boiling point, with a supplementary supply of heat from the outside. The reagents vaporize without direct contact with the molten metal but with heat transmission by conduction and radiation, before passing through the expansion chamber into a deep area of the bath and circulating therein. The inoculants are introduced through the expansion chamber, the bottom of which is formed by the bath itself, and melted by direct contact with the molten metal, supersaturating it locally and circulating in the bath due to the combined action of the vapors drawing the reagent materials leaving the chamber and the metallostatic thrust exercised by the bath which has a greater density than the superinoculated metal.

Thus, by solubilizing they perform the chemical and physical actions necessary to obtain a bath with a high homogeneity, without impurities and ready to be poured into the molds, thereby reducing the consumption of reagents and inoculants, energy loss and pollution.

The aims of this invention are:

to perform a discontinuous treatment, namely with definite quantities of metal and with known homogeneous characteristics, thus—by means of the continuous feeding system—reducing the quantity of reaction material contained in the bath and hence the development of any violent reactions should the solid or liquid reagents accidentally come into contact with the bath;

to vaporize and solubilize elements with a boiling point higher than the temperature of the bath:

to effect the addition and distribution of inoculants to favor—in cast iron—solidification of the graphite according to the stable system, even simultaneously with the vaporizable element promoting the formation of spheroidal graphite and/or variants thereof;

to effect a continuous treatment, namely for indefinite quantities of metal with continually varying characteristics of temperature, chemical composition and capacity, obtaining after the treatment a bath with the required features;

to control continuously the process of vaporization and inoculation, regulating it to ensure the complete solubilization of the reagents/inoculants added, thus avoiding loss due to oxidation or the formation of impurities;

to eliminate difficult metallurgical operations thank to complete automation and control of the production cycle which, in the case of spheroidal cast iron and its variants (e.g. vermiculite), gives an inoculated material ready for casting.

Another important point is the possibility of using reagent raw materials with a high boiling point, such as Ca, Sr, Ba or La, which promote favorable metallurgical structures, and the possibility of adapting the process in real time to the actual conditions of the metal to be processed with extremely good prospects on account of the current state of the art.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
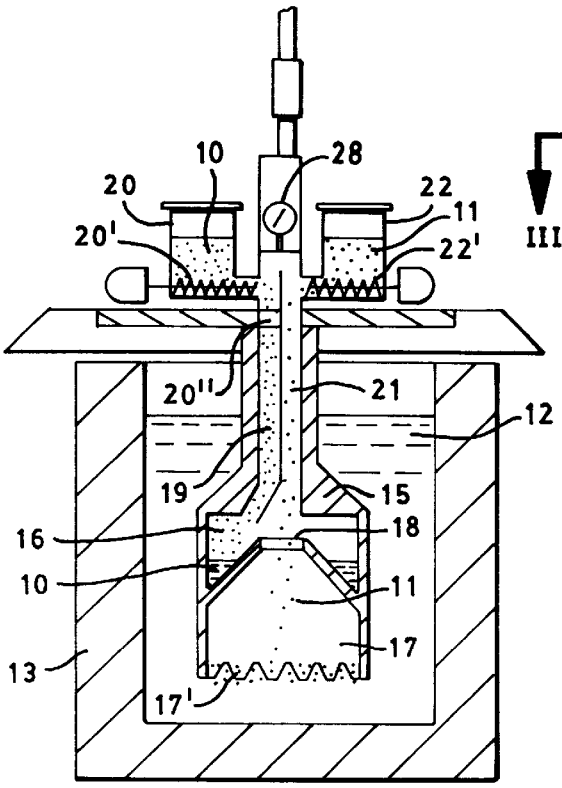
FIG. 1 is, in vertical section, an example of equipment suitable for discontinuous metallurgical treatment in a molten bath in a ladle.

The method of treatment according to the invention includes continuous delivery of a reagent 10 and, if necessary, inoculant 11 into a continuous or discontinuous molten bath, namely a known or indefinite quantity. The bath, if of a known and definite quantity, may be contained in a vessel such as a ladle 13 and changed after each treatment; if of an indefinite quantity, it may flow through a vessel such as a basin or along a channel 14.

Such delivery of the reagent 10 or inoculant 11 is obtained by means of at least one special container unit 15 immersed in the molten bath to be treated 12, hereinafter referred to as a reactor and having a vaporization chamber 16 and an expansion chamber 17, interconnecting by means of a passage 18 situated at a set level above the vaporization chamber 16 and/or the free surface. Each reactor may be in a single piece or comprised of various parts, even not homogenous, but made of a gas-tight material with appropriate physical and mechanical properties to withstand operating stress and maintain the internal pressure which is generated inside during the reactions and which prevents the molten metal from returning into the expansion chamber. It should be noted that the reactor can be installed in a fixed or movable position.

The vaporization chamber 16 and the expansion chamber 17 may be coaxial or placed side by side. Correspondingly, the geometry of the reactor 15 may vary widely from execution, as may the configuration of the reactor in or in relation to the bath to treat. Correspondingly, the reactor 15 may be in the shape of an immersed bell in the center or to one side of the molten bath in a ladle 13, as shown in FIG. 1. Alternatively, the reactor 15 may be in the shape of a block placed along the wall of a tank or channel 14 as shown in FIGS. 5–8. In all cases, the vaporization chamber 16 is open at the top and communicates only with the expansion chamber 17 through the passage 18, and not with the bath. The molten bath is only in contact with the side walls and/or bottom of the vaporization chamber 16. On the other hand, the expansion chamber 17 communicates at the top with the vaporization chamber 16 through the passage 18, whereas at the bottom and/or side it is completely or partially open directly towards the molten bath through possible passages 17'.

To the vaporization chamber 16 there is connected a first duct 19 for delivering the reagent material contained in and coming from a first supply tank/metering unit 20, 20' (in the drawings this tank/metering unit is represented for granular materials, but it may be envisaged for materials in wire or powder form.) To the expansion chamber there is connected a second duct 21 for delivering inoculating material 11 contained in and coming from a second tank/metering unit 22, 22'. The tanks/metering units 20, 22 are situated superiorly over or anyway out of the molten treatment bath 12 and the ducts 19, 21 from the tanks/metering units may be united in a single assembly or separate from each other. In any case, the reagent 10 and the inoculant 11 are delivered separately, although concomitantly, into the vaporization chamber 16 and the expansion chamber 17, respectively.

For treatment in a molten bath 12 in a ladle 13, the latter and the equipment for supplying the reagent and inoculant are suitably pressure sealed and fitted with efficient control and safety systems.

In practice, the molten bath 12, whether it be in a ladle 13 or passing into a basin or channel 14, when coming into contact with the reactor 15 transfers the fusion/vaporization heat to the reagent 10 contained in the chamber 16. The vapor produced passes through the passage 18 placed in a higher position than the level of the bath in the expansion chamber 17 and from this it is blown into the bath 12 through the passages 17' in the bottom of the chamber. The vapor rises towards the surface solubilizIng and distributing itself for the desired reactions. The metal can not rise back up into the expansion chamber 16 in that the pressure in the same is in constant equilibrium with the metallostatic pressure.

The delivery of reagent material 10 into the vaporization chamber 16 is actuated by means of the metering system 20, 20' controlled by a regulator and contained in a hopper that can be pressurized with inert gas equipped with a stop valve 20" (FIG. 7) which, as the reagent passes from the hopper 20 at atmospheric pressure into the relevant duct 19, prevents the vapor from escaping. The metering unit 20' is hermetically sealed and ensures maintenance of the pressure inside the hopper 20 during metering and acts as a base for the hopper holding a definite quantity of reagent. The opening of the metering unit 20' is controlled by a minimum level gauge 23 to ensure the constant presence of reagent. Depending on the quantity of reagent introduced into the chamber 16 via the distribution duct 19, the level of reagent varies and parallel the degree of vaporization and the quantity of reagent passing into the bath in the unit of time.

The tank/metering unit 22, 22', which is designed for feeding inoculating materials 12 into the expansion chamber 17 through the distribution duct, operates in the same way. The metal treated and possibly inoculated is tapped by a spout 24 (FIG. 6) where as the slag 25 produced collects on the wall of the basin from which it can easily be removed manually or automatically. Upon completion of the treatment, the basin is emptied through a discharge outlet 26 which allows gradual tapping of the metal and the simultaneous reduction of pressure to atmospheric level in the chambers 16, 17 of the reactor 15.

Figure 2:
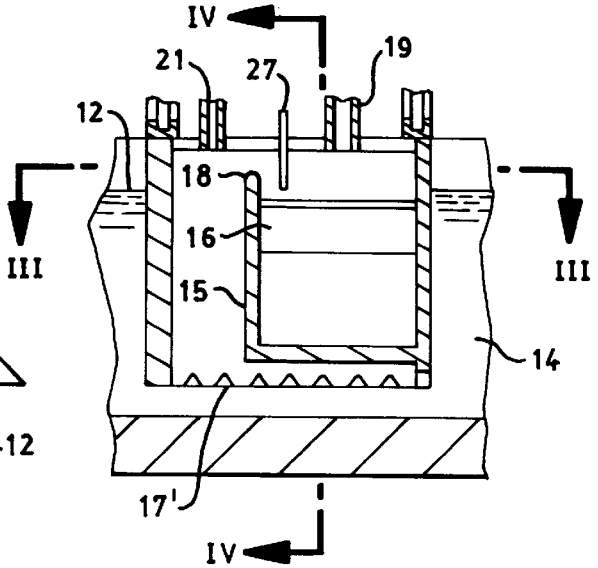
FIG. 2 is, in vertical section, an example of equipment suitable for continuous metallurgical treatment in a molten bath passing into a basin or channel.
Figure 3:
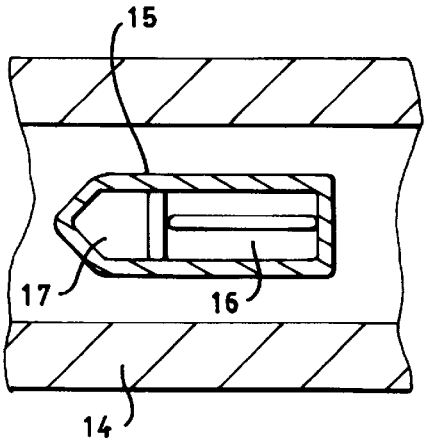
FIG. 3 is a horizontal section according to arrows III—III in FIG. 2.
Figure 4:
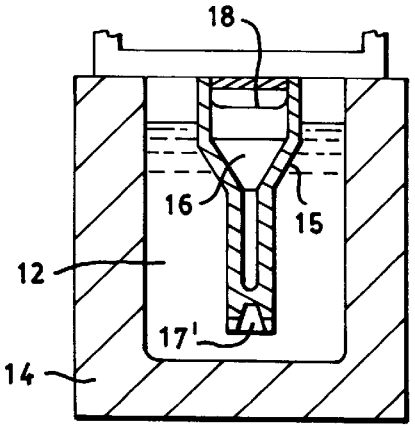
FIG. 4 is a vertical section according to arrows IV—IV in FIG. 2.
Figure 5:
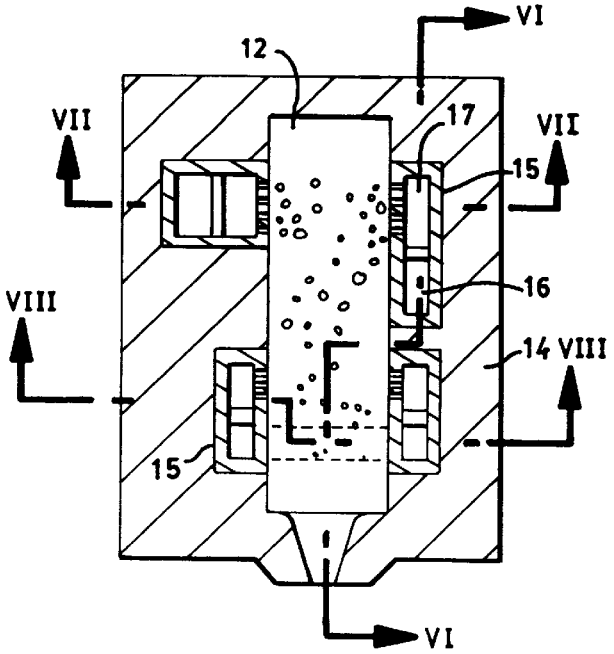
FIG. 5 is, in horizontal section, an example of multi-reactor equipment for continuous metallurgical treatment in a molten bath passing into a basin or channel.
Figure 6:
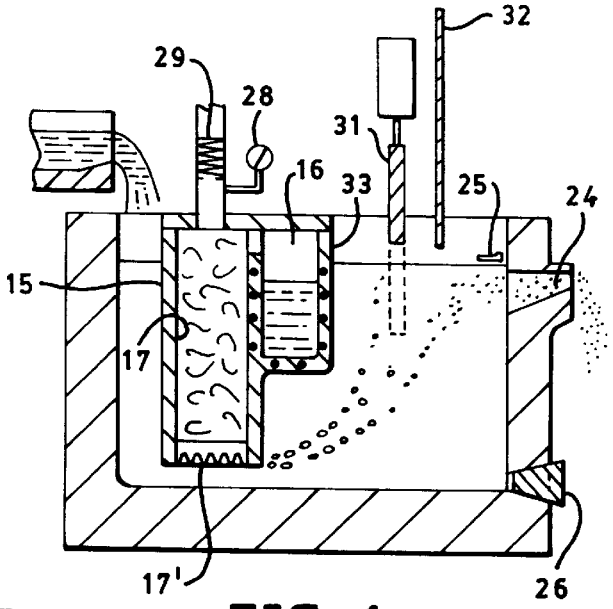
FIG. 6 is a longitudinal section according to arrows VI—VI in FIG. 5.
Figure 7:
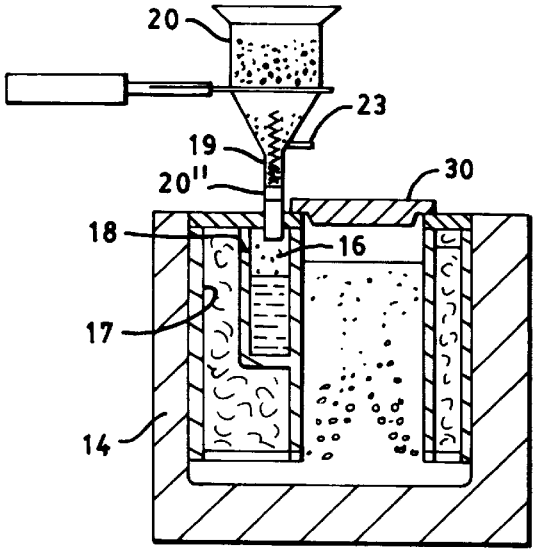
FIG. 7 is a cross section according to arrows VII—VII in FIG. 5.
Figure 9:
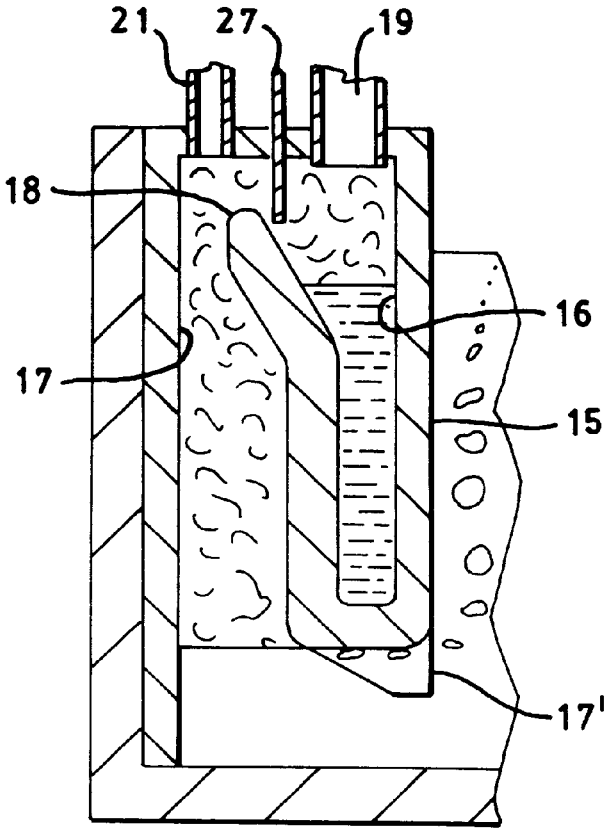
FIG. 9 is a cross section of a further configuration of the reactor for metallurgical treatment according to the invention.
Figure 8:
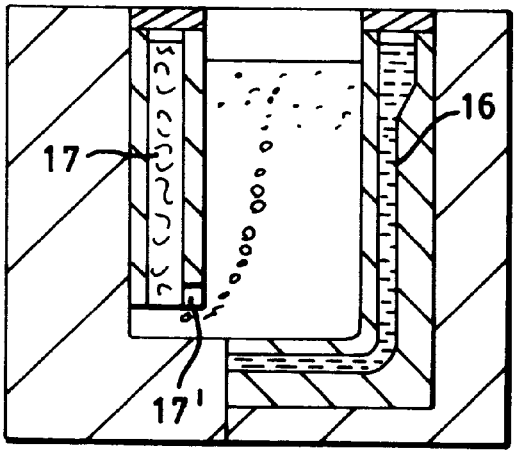
FIG. 8 is another cross section according to arrows VIII—VIII in FIG. 5.

The system designed for continuous operation is equipped with the necessary control and safety systems represented by a probe 27 (FIGS. 2 and 9) for controlling the level of the reagent 10 which regulates closing of the valve; a system 28 (FIG. 6) for continuous measurement of the pressure inside the reactor which shuts off the valve when set values are exceeded; a safety valve 29 with instant opening; a basin cover 30; a siphoning system 31 (FIG. 6)—shown in the rest position; a protection bulkhead 32 which circumscribes the system; and a gas suction and removal system (not represented). Lastly each reactor 15 may be equipped with a unit 33 operated by electricity, gas, etc. for heating the reagent 10 in the vaporization chamber when the reagent has a vaporization point exceeding the temperature of the melt.

While specific embodiments of the invention have been shown and described in detail to illustrate the application of the principles of the invention, it will be understood that the invention may be embodied otherwise without departing from such principles.

I claim:

1. A method for metallurgical treatment of a molten bath, the method comprising the steps of:

providing a molten bath;

providing a reactor in the molten bath;

adding reagent material to said reactor while said reactor is in the molten bath;

vaporizing said reagent material in said reactor while said reagent material is spaced from liquid of the molten bath;

mixing vapor from said reagent material with the molten bath.

2. The method in accordance with claim 1, wherein:

the molten bath is a metal molten bath.

3. The method in accordance with claim 1, wherein:

said adding of reagent material is continuous.

4. The method in accordance with claim 1, wherein:

said vaporizing of said reagent material is performed without direct contact with the molten bath.

5. The method in accordance with claim 1, further comprising:

adding inoculating material to said reactor.

6. The method in accordance with claim 5, further comprising:

vaporizing said inoculating material in said reactor while said inoculating material is spaced from liquid of the molten bath;

mixing vapor from said inoculating material with the molten bath.

7. The method in accordance with claim 6, wherein:

said inoculating material is continuously fed spaced from, and concurrently with, said reagent material.

8. The method in accordance with claim 1, wherein:

said vaporizing is performed with heat additional to heat from the molten bath.

9. The method in accordance with claim 1, wherein:

said vaporizing is performed while said reagent material is spaced from liquid in liquid contact with the molten bath;

said adding is substantially simultaneous with said mixing.

10. The method in accordance with claim 1, wherein:

said reagent material has no liquid contact with the molten bath.

11. A device for metallurgically treating a molten bath, the device comprising:

a reactor positionable in the molten bath, said reactor defining a reagent vaporization chamber for receiving and vaporizing reagent material, said reactor defining an inoculant vaporization chamber for receiving and vaporizing inoculating material, said reactor defining a passage communicating said reagent and inoculant vaporization chambers;

first metering unit for metering and delivering continuously the reagent material to said reagent vaporization chamber;

second metering unit for separately metering and delivering continuously the inoculating material to said inoculant vaporization chamber.

12. The device in accordance with claim 11, wherein:

said reagent vaporization chamber has walls in contact with the molten bath;

said inoculant vaporization chamber has an opening in communication with the molten bath, said reagent and inoculant vaporization chambers have means for pressurizing said chambers and preventing the molten bath from entering said inoculant vaporization chamber.

13. The device in accordance with claim 11, wherein:

said reagent and inoculant vaporization chambers are united concentrically in a body with respect to one another.

14. The device in accordance with claim 11, wherein:

said reagent and inoculant vaporization chambers are arranged one beside the other in a body.

15. The device in accordance with claim 11, further comprising:

a heating unit in said reagent vaporization chamber for heating the reagent material.

16. The device in accordance with claim 11, further comprising:

duct work for guiding the reagent material and inoculating material from said first and second metering units.

17. The device in accordance with claim 11, wherein:

said reactor is immersed in the molten bath.

18. The device in accordance with claim 11, wherein:

one of a tank and a channel holds the molten bath;

said reactor is arranged on a wall of said one of said tank and channel.

19. The device in accordance with claim 11, wherein:

said reagent vaporization chamber holds the reagent material spaced from liquid of the molten bath.

* * * * *